US011148418B2

(12) United States Patent
Tomioka

(10) Patent No.: US 11,148,418 B2
(45) Date of Patent: Oct. 19, 2021

(54) HEAD UNIT AND INKJET RECORDING APPARATUS

(71) Applicant: KYOCERA Document Solutions Inc., Osaka (JP)

(72) Inventor: Hiroyuki Tomioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/749,709

(22) Filed: Jan. 22, 2020

(65) Prior Publication Data

US 2020/0238700 A1 Jul. 30, 2020

(30) Foreign Application Priority Data

Jan. 24, 2019 (JP) ..... JP2019-010414

(51) Int. Cl.
*B41J 2/14* (2006.01)
*B41J 2/175* (2006.01)

(52) U.S. Cl.
CPC ..... *B41J 2/14145* (2013.01); *B41J 2/175* (2013.01)

(58) Field of Classification Search
CPC ..... B41J 2/14145; B41J 2/175
See application file for complete search history.

(56) References Cited

U.S. PATENT DOCUMENTS 7,370,923 B2 5/2008 Tanno et al.
7,614,729 B2 11/2009 Koizumi
7,997,699 B2 8/2011 Koizumi
8,157,355 B2 4/2012 Akahane
8,235,511 B2 8/2012 Koizumi
2006/0007254 A1 1/2006 Tanno et al.
2006/0176345 A1 8/2006 Koizumi
2007/0120913 A1* 5/2007 Mukai ..... B41J 2/175 347/93
2009/0073234 A1 3/2009 Akahane
2010/0013895 A1 1/2010 Koizumi
2011/0050793 A1 3/2011 Kumagai et al.
2011/0050794 A1* 3/2011 Koike ..... B41J 2/125 347/22

(Continued)

FOREIGN PATENT DOCUMENTS

CN 1761568 A 4/2006
CN 101434149 A 5/2009

(Continued)

OTHER PUBLICATIONS

The extended European search report issued by the European Patent Office dated May 26, 2020, which corresponds to European Patent Application No. 20153091.2-1017 and is related to U.S. Appl. No. 16/749,709.

(Continued)

*Primary Examiner* — Jason S Uhlenhake
(74) *Attorney, Agent, or Firm* — Studebaker & Brackett PC

(57) ABSTRACT

A head unit includes a recording head, a pipe member, and an ink supply section. The recording head ejects an ink. The pipe member supplies the ink to the recording head. The ink supply section supplies the ink to the pipe member. The ink supply section includes a flow channel in which the ink flows toward one end of the pipe member. The ink supply section includes a heating member located beside the flow channel.

10 Claims, 7 Drawing Sheets

(56) References Cited

U.S. PATENT DOCUMENTS

| | | | | |
|---|---|---|---|---|
| 2011/0261121 | A1 | 10/2011 | Koizumi | |
| 2012/0069098 | A1* | 3/2012 | Uezawa | B41J 2/175 347/65 |

FOREIGN PATENT DOCUMENTS

| | | | |
|---|---|---|---|
| EP | 1 790 482 | A2 | 5/2007 |
| EP | 3 205 504 | A1 | 8/2017 |
| JP | 2006-21380 | A | 1/2006 |
| JP | 2011-201231 | A | 10/2011 |

OTHER PUBLICATIONS

An Office Action mailed by China National Intellectual Property Administration dated Dec. 17, 2020, which corresponds to Chinese Patent Application No. 202010063434.1 and is related to U.S. Appl. No. 16/749,709.

* cited by examiner

HEAD UNIT AND INKJET RECORDING APPARATUS

INCORPORATION BY REFERENCE

The present application claims priority under 35 U.S.C. § 119 to Japanese Patent Application No. 2019-010414, filed on Jan. 24, 2019. The contents of this application are incorporated herein by reference in their entirety.

BACKGROUND

The present disclosure relates to a head unit and an inkjet recording apparatus.

An inkjet recording apparatus has a nozzle surface in which multiple nozzle orifices are formed. The inkjet recording apparatus ejects ink from all or some of the nozzle orifices to record an image on a recording medium. The ink may increase in viscosity in a low-temperature environment. Therefore, ink ejection performance may not be exhibited to a desired level in a low-temperature environment. In view of the foregoing, a configuration has been proposed in which the ink is heated by a heater before ejection of the ink.

SUMMARY

A head unit according to an aspect of the present disclosure includes a recording head, a pipe member, and an ink supply section. The recording head ejects an ink. The pipe member supplies the ink to the recording head. The ink supply section supplies the ink to the pipe member. The ink supply section includes a flow channel in which the ink flows toward one end of the pipe member. The ink supply section includes a heating member located beside the flow channel.

An inkjet recording apparatus according to an aspect of the present disclosure includes the above-described head unit.

DETAILED DESCRIPTION

Figure 1:
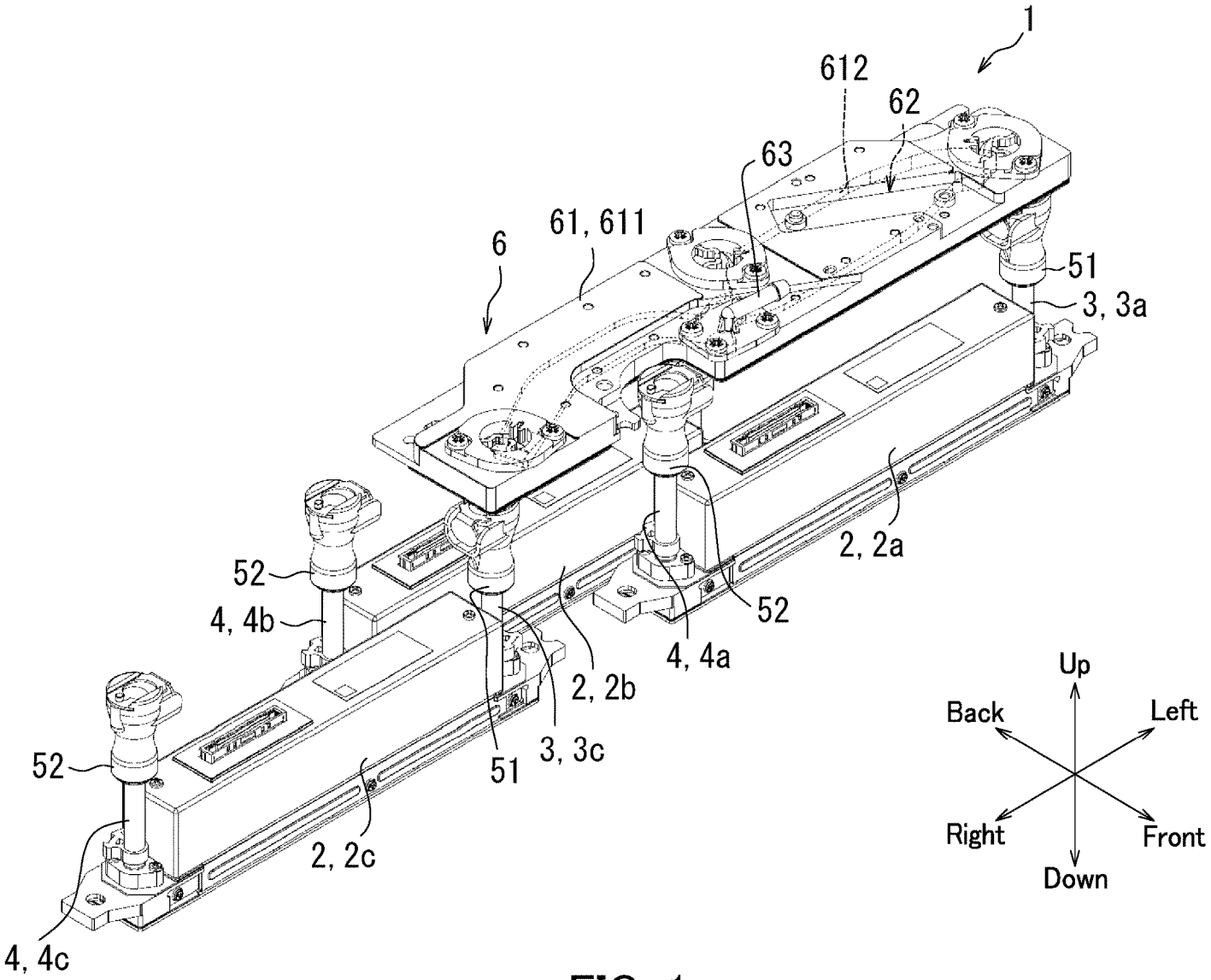
FIG. 1 is a perspective view of a head unit according to an embodiment of the present disclosure.

The following describes an embodiment of the present disclosure with reference to the accompanying drawings. However, elements that are the same or equivalent are indicated by the same reference signs in the drawings and description thereof is not repeated. Note that some overlapping description may be omitted where appropriate. Although a front-back direction, an up-and-down direction, and a left-right direction are indicated in some drawings in order to facilitate understanding, these directions are not intended to limit orientations of a head unit and an inkjet recording apparatus according to the present disclosure during manufacture or use.

Figure 2:
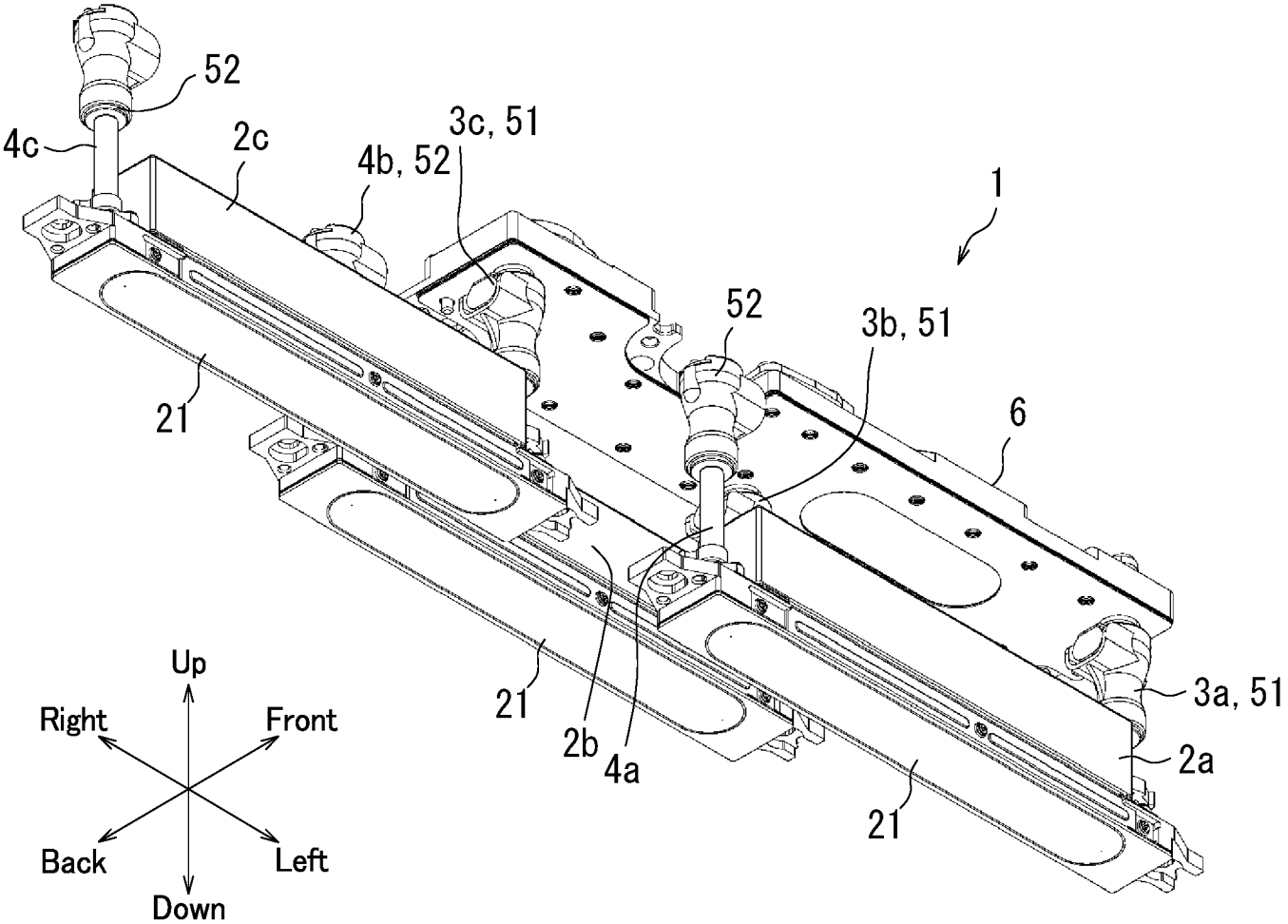
FIG. 2 is a perspective view of the head unit according to the embodiment of the present disclosure.

First, a head unit 1 according to the present embodiment will be described with reference to FIGS. 1 and 2. FIGS. 1 and 2 are each a perspective view of the head unit 1 according to the present embodiment. Specifically, FIG. 1 illustrates the head unit 1 as viewed obliquely downward from right front thereof. FIG. 2 illustrates the head unit 1 as viewed obliquely upward from right front thereof. As illustrated in FIGS. 1 and 2, the head unit 1 according to the present embodiment includes three recording heads 2, three supply pipe members 3, three circulation pipe members 4, a dampening member 6, three first coupling members 51, and three second coupling members 52.

The three recording heads 2 each eject ink. Specifically the three recording heads 2 eject ink of the same color. Each of the recording heads 2 extends in the left-right direction. In the present embodiment, the three recording heads 2 include a first recording head 2*a*, a second recording head 2*b*, and a third recording head 2*c*. The first to third recording heads 2*a* to 2*c* are arranged in a staggered manner in the left-right direction. Specifically, the second recording head 2*b* is arranged behind the first and third recording heads 2*a* and 2*c*.

The three recording heads 2 each have a nozzle surface 21 (see FIG. 2). Each of the recording heads 2 ejects the ink from a corresponding one of the nozzle surfaces 21. Specifically, multiple nozzle orifices are formed in the nozzle surface 21 and the ink is ejected from the nozzle orifices.

The three supply pipe members 3 supply the ink to the respective three recording heads 2. The three supply pipe members 3 each have one end (lower end) connected to a left end of a corresponding one of the recording heads 2. The three supply pipe members 3 extend upward from the respective recording heads 2. In the present embodiment, the three supply pipe members 3 include a first supply pipe member 3*a*, a second supply pipe member 3*b*, and a third supply pipe member 3*c*. The first supply pipe member 3*a* supplies the ink to the first recording head 2*a*. The second supply pipe member 3*b* supplies the ink to the second recording head 2*b* (see FIG. 2). The third supply pipe member 3*c* supplies the ink to the third recording head 2*c*.

The three circulation pipe members 4 each have one end (lower end) connected to a right end of a corresponding one of the recording heads 2. The three circulation pipe members 4 extend upward from the respective recording heads 2. In the present embodiment, the three circulation pipe members 4 include a first circulation pipe member 4*a*, a second circulation pipe member 4*b*, and a third circulation pipe member 4*c*. The first circulation pipe member 4*a* is connected to the first recording head 2*a*. The second circulation pipe member 4*b* is connected to the second recording head 2*b*. The third circulation pipe member 4*c* is connected to the third recording head 2*c*.

The ink flows into each of the circulation pipe members 4 from a corresponding one of the recording heads 2 in a purge operation. The purge operation is an operation to supply ink to the recording heads 2 by applying pressure to the ink to a degree at which the ink is not ejected from the nozzle orifices. The purge operation is executed for the purpose of expelling bubbles from the ink, for example. When the purge operation is executed, the ink is discharged from each of the three recording heads 2 to a corresponding one of the circulation pipe members 4. Specifically, the ink flowing in the recording heads 2 from the supply pipe members 3 flows into the circulation pipe members 4 through circulation channels established inside the respective recording heads 2. In so doing, bubbles flow into the recording heads 2 together with the ink from the supply pipe members 3. The bubbles flow together with the ink into the circulation pipe members 4 through the circulation channels. The bubbles and the ink flowing in each circulation pipe member 4 return to an ink supply unit 15, which will be described later with reference to FIG. 6.

The dampening member 6 is disposed above the three recording heads 2. The dampening member 6 supplies the ink to the three supply pipe members 3. The ink is accordingly supplied to the three recording heads 2 through the respective three supply pipe members 3. The dampening member 6 is an example of an ink supply section.

The three first coupling members 51 each connect the other end (upper end) of a corresponding one of the three supply pipe members 3 to the dampening member 6. The three second coupling members 52 each connect the other end (upper end) of a corresponding one of the three circulation pipe members 4 to a circulation pipe 164, which will be described later with reference to FIG. 6.

The dampening member 6 of the present embodiment will be further described with reference to FIG. 1. As illustrated in FIG. 1, the dampening member 6 includes a base 61, a flow channel 62, and an ink flow-in portion 63.

The base 61 is a plate-shaped member. The base 61 extends in the left-right direction. In other words, the base 61 extends in a direction in which the three recording heads 2 are arranged. The base 61 of the present embodiment is a metal member. The base 61 includes an upper wall 611.

The ink flow-in portion 63 is located in the upper wall 611 of the base 61. The ink flow-in portion 63 is located in a substantial center of the base 61 in the left-right direction. The ink is supplied to the ink flow-in portion 63 from the ink supply unit 15, which will be described with reference to FIG. 6.

The flow channel 62 is established inside the base 61. The base 61 includes an inner wall 612 thereinside that constitutes a side surface of the flow channel 62. The ink flows into the flow channel 62 from the ink flow-in portion 63. The flow channel 62 guides the ink to the respective other ends (upper ends) of the three supply pipe members 3. Note that a part of the upper wall 611 of the base 61 constitutes a ceiling surface of the flow channel 62. The upper wall 611 is an example of a wall part.

Figure 3:
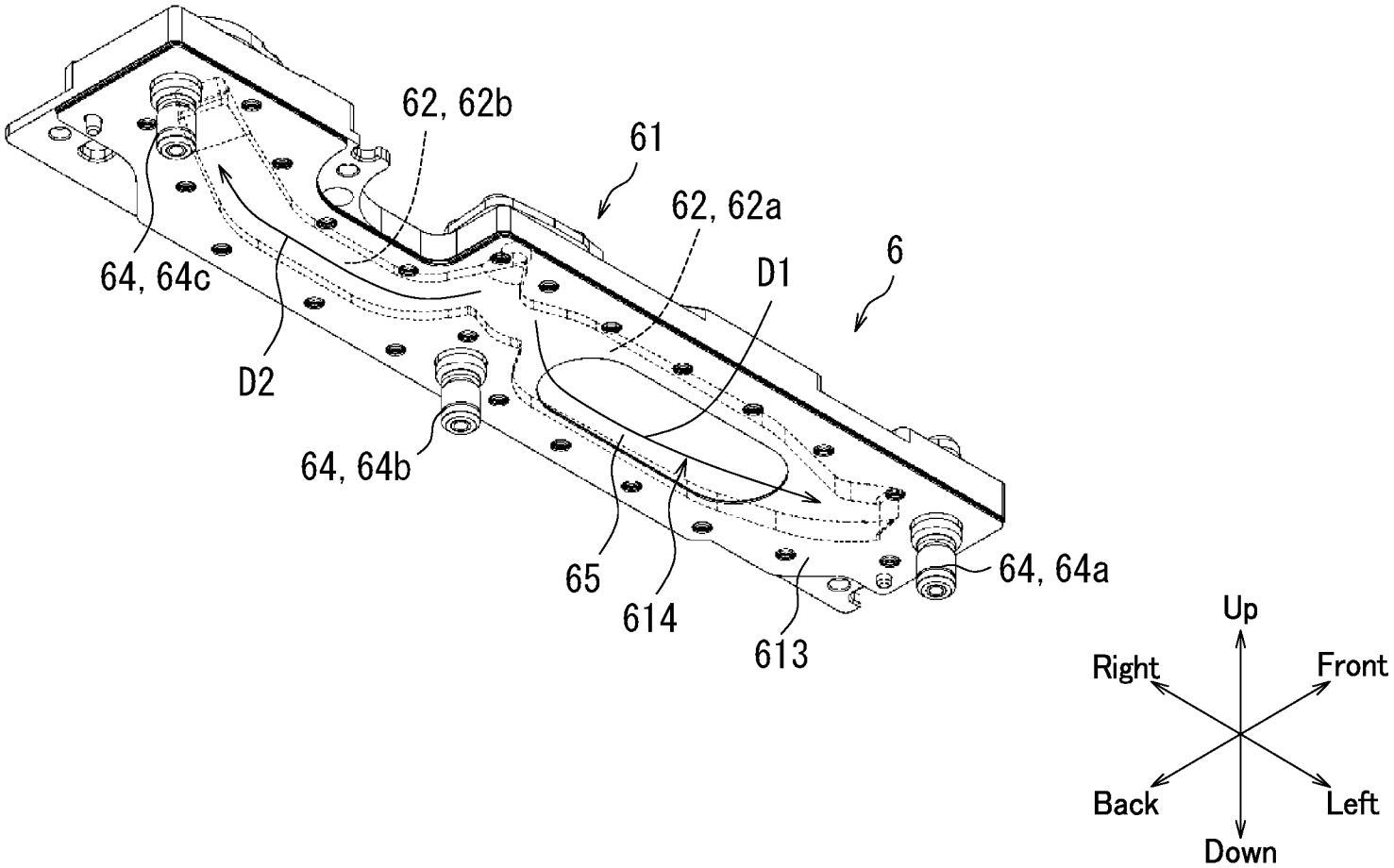
FIG. 3 is a perspective view of a dampening member according to the embodiment of the present disclosure.

The dampening member 6 of the present embodiment will be further described with reference to FIG. 3. FIG. 3 is a perspective view of the dampening member 6 in the present embodiment. Specifically, FIG. 3 illustrates the dampening member 6 as viewed obliquely upward from right front thereof. As illustrated in FIG. 3, the base 61 includes a lower wall 613. A part of the lower wall 613 of the base 61 constitutes a bottom surface of the flow channel 62. The dampening member 6 includes three ink flow-out portions 64 in the lower wall 613 of the base 61.

The three ink flow-out portions 64 each protrude downward from the lower wall 613 of the base 61. The three ink flow-out portions 64 each communicate with the other end (upper end) of a corresponding one of the three supply pipe members 3 described with reference to FIGS. 1 and 2. The dampening member 6 supplies the ink to the three supply pipe members 3 by allowing the ink to flow thereinto from the three ink flow-out portions 64.

Specifically, the three ink flow-out portions 64 are connected to the other ends of the three supply pipe members 3 by means of the respective three first coupling members 51 described with reference to FIGS. 1 and 2. The three ink flow-out portions 64 include a first ink flow-out portion 64*a*, a second ink flow-out portion 64*b*, and a third ink flow-out portion 64*c* in the present embodiment. The first ink flow-out portion 64*a* is connected to the other end of the first supply pipe member 3*a* by means of one of the three first coupling members 51. In the above configuration, the ink is supplied from the first ink flow-out portion 64*a* to the first supply pipe member 3*a*. The second ink flow-out portion 64*b* is connected to the other end of the second supply pipe member 3*b* by means of another one of the three first coupling members 51. In the above configuration, the ink is supplied from the second ink flow-out portion 64*b* to the second supply pipe member 3*b*. The third ink flow-out portion 64*c* is connected to the other end of the third supply pipe member 3*c* by means of the remaining one of the three first coupling members 51. In the above configuration, the ink is supplied from the third ink flow-out portion 64*c* to the third supply pipe member 3*c*.

As illustrated in FIG. 3, the flow channel 62 includes a first flow channel 62*a* and a second flow channel 62*b*. Specifically, the flow channel 62 extends in the left-right direction. The first flow channel 62*a* is a portion of the flow channel 62 located left of a substantial center of the flow channel 62 in the left-right direction. The second flow channel 62*b* is a portion of the flow channel 62 located right of the substantial center of the flow channel 62 in the left-right direction. One end of the first flow channel 62*a* communicates with an upper end opening of the first ink flow-out portion 64*a*. One end of the second flow channel 62*b* communicates with an upper end opening of the third ink flow-out portion 64*c*. In the following description, the substantial center of the flow channel 62 in the left-right direction may be referred to as a "center of the flow channel 62".

The ink supplied to the ink flow-in portion 63 described with reference to FIG. 1 flows out to the center of the flow channel 62 from the ink flow-in portion 63. A portion of the ink flowing out from the ink flow-in portion 63 to the flow channel 62 flows along the first flow channel 62*a*. Another portion of the ink flowing out from the ink flow-in portion 63 to the flow channel 62 flows along the second flow channel 62*b*. The remaining portion of the ink flowing out from the ink flow-in portion 63 to the flow channel 62 flows into an upper end opening of the second ink flow-out portion 64*b* via the flow channel 62.

The ink flowing in the first flow channel 62*a* flows into the upper end opening of the first ink flow-out portion 64*a* in a first flow direction D1. The ink flowing in the second flow channel 62*b* flows into the upper end opening of the third ink flow-out portion 64*c* in a second flow direction D2. In the above configuration, the ink flows from the first flow channel 62*a* into the first ink flow-out portion 64*a*, thereby being supplied to the first recording head 2*a* described with reference to FIGS. 1 and 2. Likewise, the ink flows from the second flow channel 62*b* into the third ink flow-out portion 64*c*, thereby being supplied to the third recording head 2*c* described with reference to FIGS. 1 and 2.

As illustrated in FIG. 3, the lower wall 613 of the base 61 has an opening 614. The opening 614 opens toward the first flow channel 62*a*. The dampening member 6 further includes a film 65 covering the opening 614. The film 65 extends along the flow channel 62. In detail, the film 65 constitutes a part of the bottom surface of the flow channel 62. Specifically, the film 65 constitutes a part of a bottom surface of the first flow channel 62*a*. The film 65 is an example of a thin film member. Note that no particular limitations are placed on the length of the film 65 along the flow channel 62 as long as variation in ink pressure can be absorbed.

The film 65 is elastic. The film 65 includes for example a polyethylene terephthalate (PET) film as a base material. As a result of the film 65 constituting a part of a plane that constitutes the flow channel 62, pressure variation of the ink can be absorbed by the film 65. In other words, an amount of variation in ink pressure can be reduced by the film 65. Specifically, the film 65 expands and contracts according to variation in ink pressure. As a result, variation in ink pressure is absorbed. Note that no particular limitations are placed on a length of the film 65 along the flow channel 62 so long as ink pressure can be absorbed.

Variation in ink pressure may serve as a cause of ink dripping from a nozzle in suspension of ink ejection. Variation in ink pressure may also serve as a cause of the ink flowing in at least one of the three circulation pipe members 4 described with reference to FIGS. 1 and 2 in suspension of ink ejection.

Specifically, the recording heads 2 eject the ink according to a to-be-recorded image. In detail, the image includes a print portion and a non-print portion. The recording heads 2 perform ink ejection for the print portion while suspending ink ejection for the non-print portion. Variation in ink pressure occurs upon ink ejection being suspended for the non-print portion. More specifically, the recording heads 2 each include a piezoelectric element. Driving of the piezoelectric element ejects the ink. Suspension of driving of the piezoelectric element causes suspension of ink ejection. Variation in ink pressure occurs due to suspension of driving of the piezoelectric element.

According to the present embodiment, the film 65 absorbs variation in ink pressure. Therefore, the ink is difficult to drip from the nozzles during suspension of ink ejection. Furthermore, it is difficult for the ink to flow into the three circulation pipe members 4 described with reference to FIGS. 1 and 2 in suspension of ink ejection.

Figure 4:
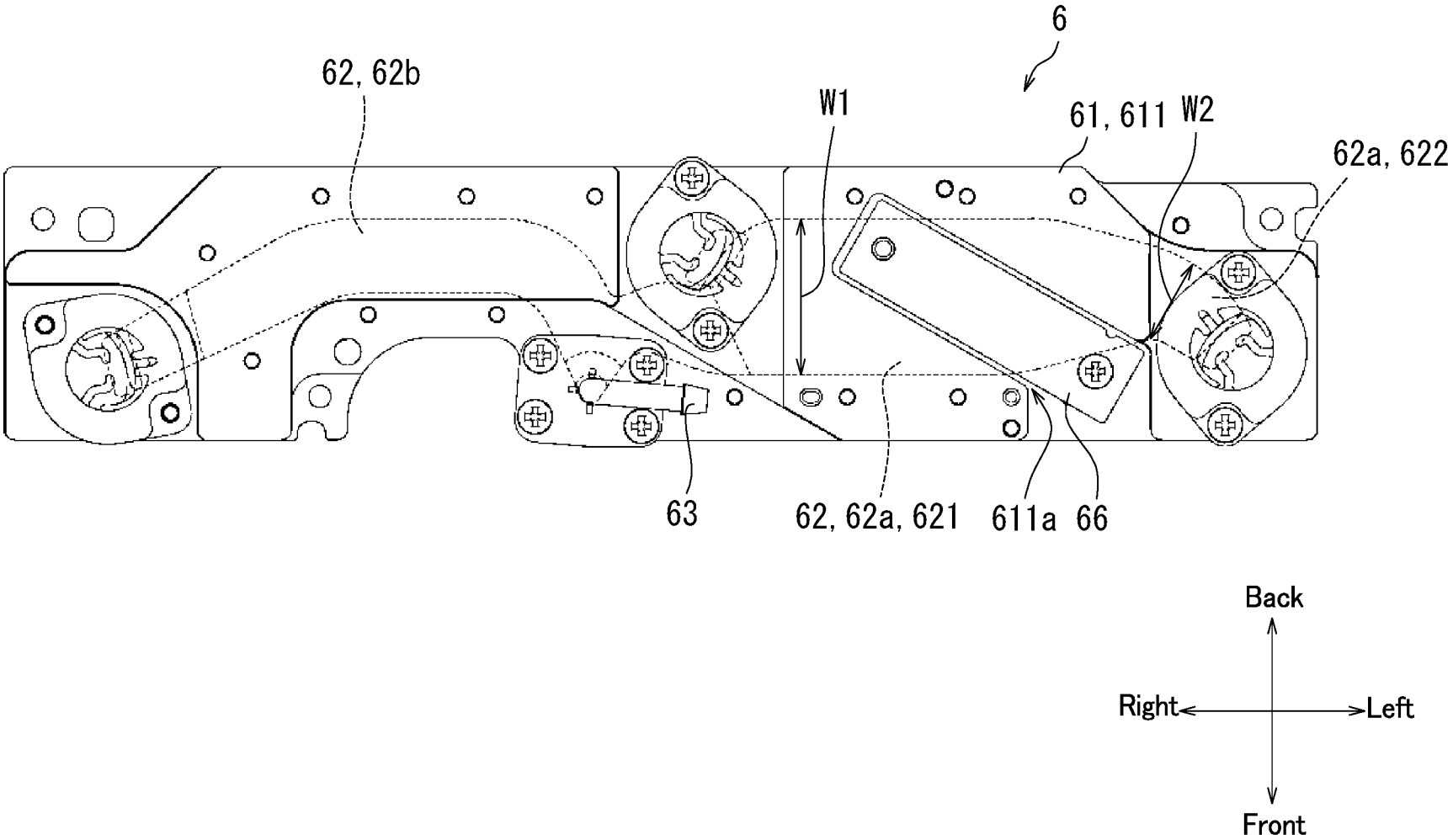
FIG. 4 is a top view of the dampening member according to the embodiment of the present disclosure.

The dampening member 6 of the present embodiment will be further described with reference to FIG. 4. FIG. 4 is a top view of the dampening member 6 in the present embodiment. As illustrated in FIG. 4, the dampening member 6 includes a heater 66 located beside the flow channel 62. The heater 66 is an example of a heating member. The heater 66 is for example a ceramic heater. The ceramic heater generates heat by being energized.

The head unit 1 according to the present embodiment has been described so far with reference to FIGS. 1 to 4. According to the present embodiment, the heater 66 is located beside the flow channel 62. In the above configuration, the heater 66 can efficiently heat the ink flowing in the flow channel 62. Thus, the temperature of the ink can be efficiently increased before ejection of the ink. Therefore, an increase in ink viscosity can be inhibited in the present embodiment even in a low-temperature environment. A possibility can accordingly be reduced that ink ejection performance is not exhibited to a desired level.

The dampening member 6 of the present embodiment will be still further described with reference to FIG. 4. As illustrated in FIG. 4, the first flow channel 62*a* includes a wide portion 621 and a narrow portion 622.

The narrow portion 622 is located on a side of the first ink flow-out portion 64*a* described with reference to FIG. 3. In other words, the narrow portion 622 is located on a side of the first supply pipe member 3*a* described with reference to FIGS. 1 and 2. The wide portion 621 is connected to the narrow portion 622. In other words, the wide portion 621 and the narrow portion 622 communicate with each other. The wide portion 621 is located upstream of the narrow portion 622 in terms of a direction of ink flow.

The wide portion 621 has a width W1 which is wider than a width W2 of the narrow portion 622. In the above configuration, a flow channel sectional area of the wide portion 621 is larger than that of the narrow portion 622. Accordingly, a flow rate of the ink flowing in the wide portion 621 is slower than a flow rate of the ink flowing in the narrow portion 622.

The film 65 described with reference to FIG. 3 extends along the wide portion 621. In other words, the film 65 constitutes a part of a bottom surface of the wide portion 621. In the above configuration, the film 65 absorbs variation in ink pressure at a location where the ink flows slowly. Thus, variation in ink pressure can be efficiently absorbed.

Furthermore, the heater 66 is located beside the first flow channel 62*a* as illustrated in FIG. 4. Specifically, the heater 66 is located along the wide portion 621. In the above configuration, the heater 66 can increase the temperature of the ink at a location where the ink flows slowly. Thus, the temperature of the ink can be efficiently increased.

Note that the ink flowing in the second flow channel 62*b* also increases in temperature due to heat generated by the heater 66. Specifically, the heater 66 heats the base 61 to increase the temperature of the base 61, thereby increasing the temperature of the ink flowing in the second flow channel 62*b*. The base 61 of the present embodiment is a metal member. In other words, the base 61 is made from a material having relatively high thermal conductivity. In the above configuration, the base 61 readily increases in temperature due to heat generated by the heater 66. Thus, the temperature of the ink flowing in the second flow channel 62*b* can be efficiently increased.

As illustrated in FIG. 4, the heater 66 is disposed outside the upper wall 611 of the base 61. In other words, the heater 66 is disposed outside the flow channel 62. More specifically, the upper wall 611 of the base 61 has a recess 611*a*. The recess 611*a* has a contour shape corresponding to an outer shape of the heater 66, and the heater 66 is arranged in the recess 611*a*. Arrangement of the heater 66 in the recess 611*a* can reduce a distance between the heater 66 and the flow channel 62. Thus, the temperature of the ink can be efficiently increased.

Note that the heater 66 may be disposed inside the flow channel 62. However, in a configuration in which the heater 66 is disposed inside the flow channel 62, the sectional area of the flow channel 62 is reduced to increase the flow rate of the ink. This may lead to inefficient temperature increase of the ink. By contrast, the heater 66 is disposed outside the flow channel 62 in the present embodiment. Therefore, the temperature of the ink can be increased efficiently.

Figure 5:
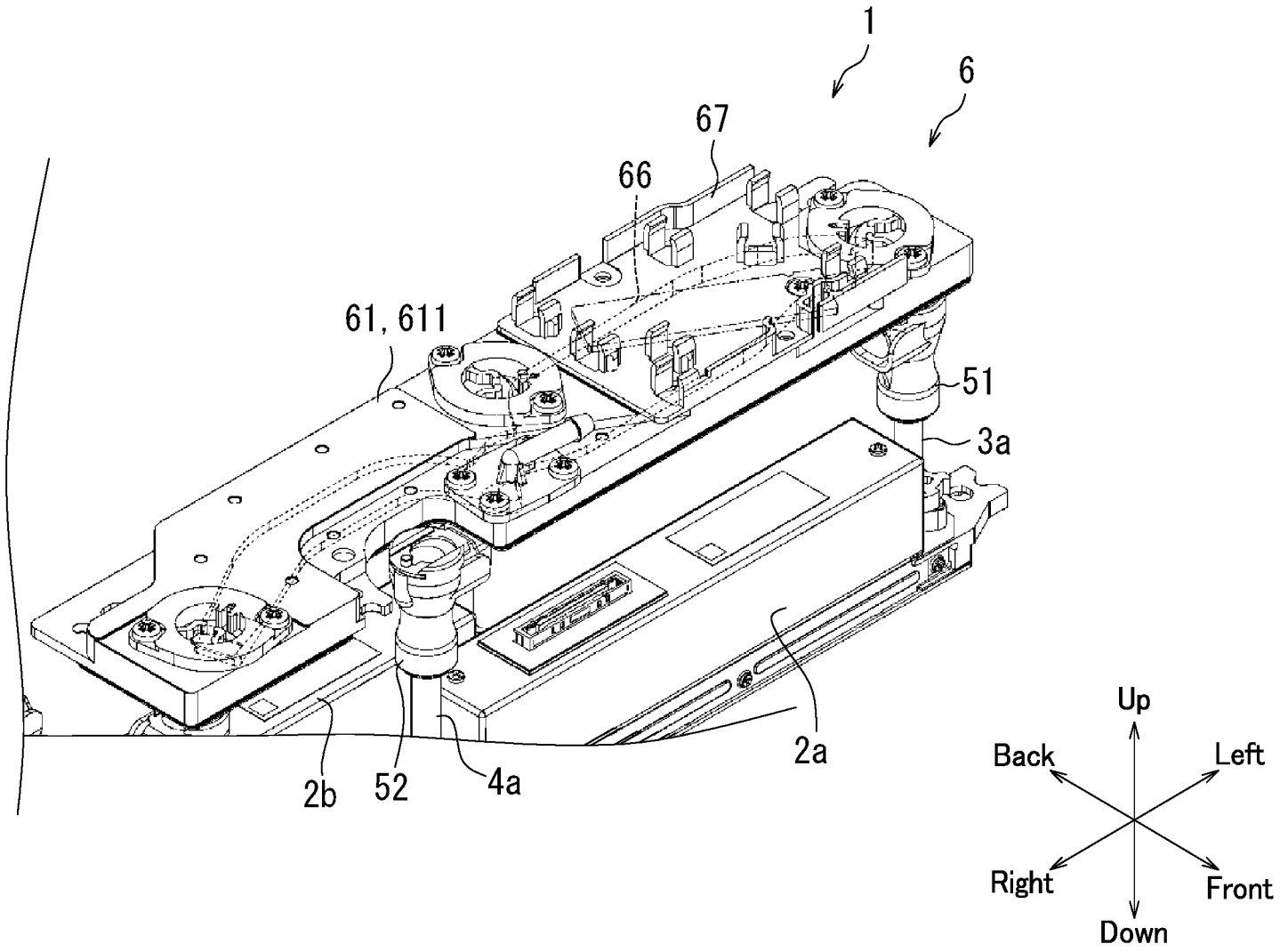
FIG. 5 is a perspective view of a part of the head unit according to the embodiment of the present disclosure.

The dampening member 6 of the present embodiment will be further described with reference to FIG. 5. FIG. 5 is a perspective view of a part of the head unit 1 according to the present embodiment. Specifically, FIG. 5 illustrates the head unit 1 as viewed obliquely downward from right front thereof.

As illustrated in FIG. 5, the dampening member 6 of the present embodiment further includes a lid 67. The lid 67 covers the heater 66. Specifically, the lid 67 is disposed on the upper wall 611 of the base 61. According to present embodiment, provision of the lid 67 inhibits dissipation of heat generated by the heater 66 toward outside air. Thus, the temperature of the base 61 can be increased efficiently. Accordingly, the ink flowing in the flow channel 62 can be increased efficiently.

The lid 67 is made from a material having a thermal conductivity lower than that of the base 61 in the present embodiment. In other words, the lid 67 is made from a material having relatively low heat dissipation. In the above configuration, it is difficult for heat generated by the heater 66 to dissipate toward outside air. Thus, the temperature of the ink flowing in the flow channel 62 can be increased efficiently. The base 61 contains for example a resin as a material.

Figure 6:
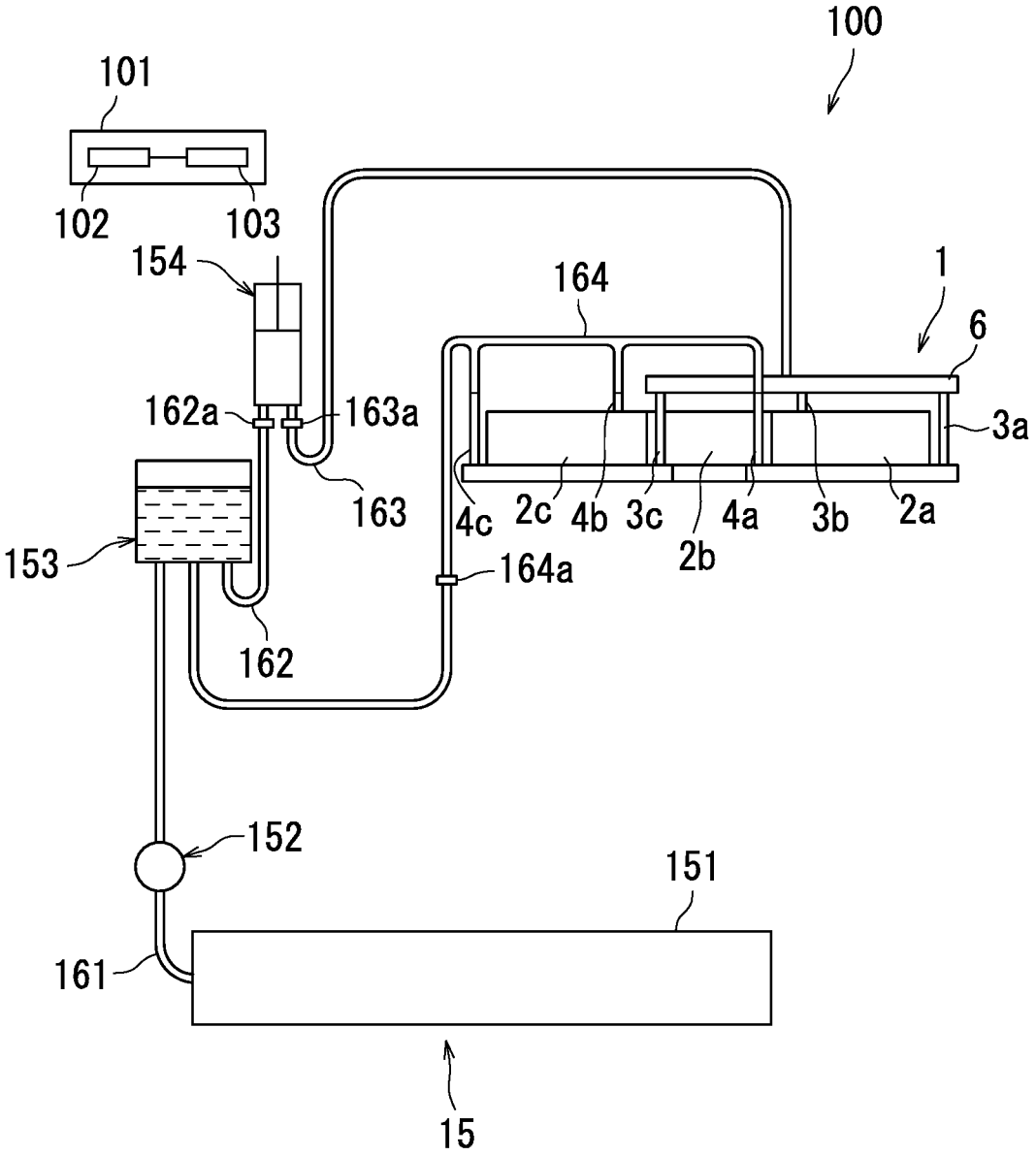
FIG. 6 is a diagram illustrating a configuration of an ink supply unit according to the embodiment of the present disclosure.

An inkjet recording apparatus 100 according to the present embodiment will be described next with reference to FIG. 6. FIG. 6 is a diagram illustrating a configuration of the ink supply unit 15 according to the present embodiment.

As illustrated in FIG. 6, the inkjet recording apparatus 100 includes the head unit 1, the ink supply unit 15, and a controller 101. The ink supply unit 15 supplies the ink to the dampening member 6. Specifically, the ink supply unit 15 supplies the ink to the ink flow-in portion 63 described with reference to FIG. 1. The controller 101 controls the ink supply unit 15. The controller 101 further controls the three recording heads 2.

The ink supply unit 15 in the present embodiment includes an ink tank 151, a supply pump 152, a sub tank 153, a syringe pump 154, a first pipe 161, a second pipe 162, a third pipe 163, a circulation pipe 164, a first valve 162*a*, a second valve 163*a*, and a circulation valve 164*a*.

The ink tank 151 contains the ink. The ink tank 151 is connected to the sub tank 153 through the first pipe 161. The first pipe 161 allows the ink to flow from the ink tank 151 to the sub tank 153. The sub tank 153 reserves the ink supplied from the ink tank 151. The sub tank 153 is connected to the syringe pump 154 through the second pipe 162. The second pipe 162 allows the ink to flow from the sub tank 153 to the syringe pump 154. The syringe pump 154 is connected to the dampening member 6 (the ink flow-in portion 63) through the third pipe 163. The third pipe 163 allows the ink to flow from the syringe pump 154 to the dampening member 6 (the ink flow-in portion 63).

The supply pump 152 is disposed in the first pipe 161. The supply pump 152 supplies the ink reserved in the ink tank 151 to the sub tank 153 according to an instruction from the controller 101.

The syringe pump 154 sucks the ink reserved in the sub tank 153 through the second pipe 162. The syringe pump 154 ejects the ink sucked from the sub tank 153 to the third pipe 163. Specifically, the syringe pump 154 includes a cylinder and a piston. The cylinder reserves therein the ink sucked from the sub tank 153. The cylinder is for example cylindrical in shape. An inlet and an outlet are located in the bottom of the cylinder. The inlet is connected to the second pipe 162. The outlet is connected to the third pipe 163.

The piston is inserted in the cylinder. The piston moves away from the bottom of the cylinder according to an instruction from the controller 101. Also, the piston moves toward the bottom of the cylinder according to an instruction from the controller 101.

When the piston moves away from the bottom of the cylinder, the ink is sucked into the cylinder. Specifically, the ink flows out from the sub tank 153 into the second pipe 162 and further flows into the cylinder through the second pipe 162.

When the piston moves toward the bottom of the cylinder, the ink flows out from the cylinder into the third pipe 163 and further flows into the dampening member 6 (the ink flow-in portion 63) through the third pipe 163.

Furthermore, in execution of the purge operation described with reference to FIG. 1, the piston moves toward the bottom of the cylinder such that the ink is supplied to the dampening member 6 (the ink flow-in portion 63) at a pressure at which no ink ejection from the three nozzle surfaces 21 is caused. Specifically, the controller 101 controls moving speed of the piston so that the ink is supplied to the dampening member 6 (the ink flow-in portion 63) at a pressure at which no ink ejection from the three nozzle surfaces 21 is caused.

The first valve 162*a* is disposed in the second pipe 162. The second valve 163*a* is disposed in the third pipe 163. The first valve 162*a* and the second valve 163*a* are each opened or closed according to an instruction from the controller 101. Specifically, while the piston moves away from the bottom of the cylinder, the first valve 162*a* is open while the second valve 163*a* is closed. By contrast, while the piston moves toward the bottom of the cylinder, the first valve 162*a* is closed while the second valve 163*a* is open.

The circulation pipe 164 allows communication between the sub tank 153 and the three circulation pipe members 4 described with reference to FIG. 1. Specifically, as described with reference to FIG. 1, the other ends (upper ends) of the three circulation pipe members 4 are each connected to the circulation pipe 164 by means of a corresponding one of the three second coupling members 52. The circulation pipe 164 allows bubbles and the ink flowing out from the three recording heads 2 (the three circulation pipe members 4) to flow into the sub tank 153 in execution of the purge operation. The sub tank 153 has a through hole. The through hole communicates with the atmosphere. The through hole is located above the liquid surface of the ink reserved in the sub tank 153. In the above configuration, the bubbles expelled from the head unit 1 to the sub tank 153 by the purge operation are expelled to the atmosphere though the through hole of the sub tank 153.

The circulation valve 164*a* is disposed in the circulation pipe 164. The circulation valve 164*a* is opened or closed according to an instruction from the controller 101. Specifically, the circulation valve 164*a* is open during execution of the purge operation and is closed during image recording.

The controller 101 includes storage 102 and a processing device 103. The storage 102 stores data and a program therein. The storage 102 includes for example semiconductor memory such as random-access memory (RAM) or read-only memory. The storage 102 may further include a storage device such as a hard disk drive (HDD). The processing device 103 includes a processor such as a central processing unit (CPU) or a micro-processing unit (MPU). The processing device 103 controls operation of each element of the inkjet recording apparatus 100 based on the program stored in the storage 102.

Figure 7:
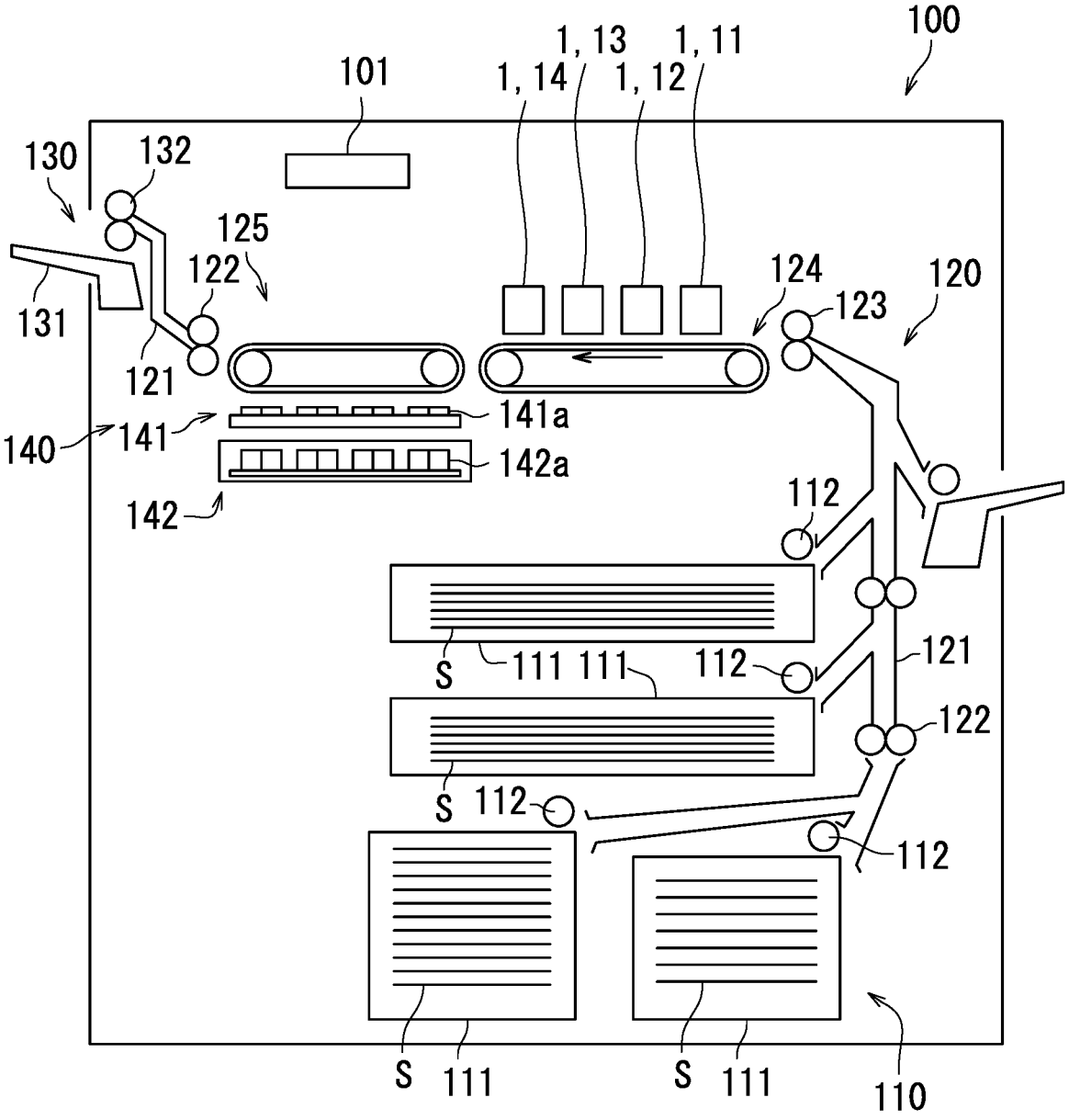
FIG. 7 is a diagram illustrating a configuration of an inkjet recording apparatus according to the embodiment of the present disclosure.

The inkjet recording apparatus 100 according to the present embodiment will be further described with reference to FIG. 7. FIG. 7 is a diagram illustrating a configuration of the inkjet recording apparatus 100 according to the present embodiment.

As illustrated in FIG. 7, the inkjet recording apparatus 100 includes a feeding section 110, a sheet conveyance section 120, an ejection section 130, and a maintenance unit 140. The inkjet recording apparatus 100 further includes four head units 1.

The feeding section 110 feeds a sheet S to the sheet conveyance section 120. The feeding section 110 in the present embodiment includes a plurality of accommodation cassettes 111 and a plurality of feeding rollers 112. The accommodation cassettes 111 each accommodate at least one sheet S. The feeding rollers 112 each feed the sheet S from a corresponding one of the accommodation cassettes 111 to the sheet conveyance section 120. Note that the sheet S is an example of a recording medium.

The sheet conveyance section 120 conveys the sheet S to the ejection section 130. Specifically, the sheet conveyance section 120 includes a plurality of conveyance guides 121, a plurality of conveyance roller pairs 122, and a registration roller pair 123. The conveyance guides 121 constitute a conveyance path for the sheet S. The conveyance roller pairs 122 convey the sheet S along the conveyance path. The registration roller pair 123 adjusts conveyance timing for the sheet S to be conveyed to a region where the sheet S is to face the four head units 1.

The sheet conveyance section 120 in the present embodiment includes a first conveyance unit 124 and a second conveyance unit 125. The first conveyance unit 124 is disposed opposite to the four head units 1. The first conveyance unit 124 conveys the sheet S in a region directly below the four head units 1. The second conveyance unit 125 conveys the sheet S fed from the first conveyance unit 124 to the ejection section 130.

The three recording heads 2 provided in each of the four head units 1 eject inks toward the sheet S being conveyed by the first conveyance unit 124. Specifically, the four head units 1 eject inks different from one another in color. In the present embodiment, the four head units 1 include a first head unit 11, a second head unit 12, a third head unit 13, and a fourth head unit 14. For example, the three recording heads 2 of the first head unit 11 eject a black ink. The three recording heads 2 of the second head unit 12 eject a cyan ink. The three recording heads 2 of the third head unit 13 eject a magenta ink. The three recording heads 2 of the fourth head unit 14 eject a yellow ink.

The inkjet recording apparatus 100 includes four ink supply units 15, which are described with reference to FIG. 6. Ink tanks 151 of the four ink supply units 15 contain respective inks different from one another in color. Specifically, the four ink supply units 15 includes a first ink supply unit, a second ink supply unit, a third ink supply unit, and a fourth ink supply unit. For example, the first ink supply unit supplies the black ink to the dampening member 6 of the first head unit 11. The second ink supply unit supplies the cyan ink to the dampening member 6 of the second head unit 12. The third ink supply unit supplies the magenta ink to the dampening member 6 of the third head unit 13. The fourth ink supply unit supplies the yellow ink to the dampening member 6 of the fourth head unit 14.

The ejection section 130 ejects the sheet S out of the inkjet recording apparatus 100. The ejection section 130 in the present embodiment includes an exit tray 131 and an ejection roller pair 132. The ejection roller pair 132 ejects the sheet S onto the exit tray 131.

The maintenance unit 140 performs maintenance on the three recording heads 2 of each of the first to fourth head units 11 to 14. The maintenance unit 140 is positioned below the second conveyance unit 125 in image recording on the sheet S and moves to a location directly below the first to fourth head units 11 to 14 in maintenance on the recording heads 2. Note that the first conveyance unit 124 is moved to a retraction position during maintenance on the recording heads 2. The retraction position is a position where the first conveyance unit 124 does not collide with the maintenance unit 140.

The maintenance unit 140 in the present embodiment includes a capping section 141 and a cleaner 142. As described with reference to FIG. 2, each recording head 2 has a nozzle surface 21. The capping section 141 includes 12 capping members 141*a*. The 12 capping members 141*a* each cap the nozzle surface 21 of a corresponding one of the recording heads 2 to provide an environment in which it is difficult for the inks to be dried.

The cleaner 142 cleans the nozzle surface 21 of each recording head 2. Specifically, the cleaner 142 includes 12 wiping blades 142*a*. The wiping blades 142*a* are made from resin as a material, for example. The wiping blades 142*a* are cleaning members that clean the respective nozzle surfaces 21. The cleaner 142 wipes ink adhering to the nozzle surface 21 of each of the recording heads 2 using a corresponding one of the wiping blades 142*a*.

An embodiment of the present disclosure has been described so far with reference to FIGS. 1 to 7. However, the present disclosure is not limited to the above-described embodiment and can be practiced in various ways within the scope without departing from the essence of the present disclosure. Furthermore, the elements of configuration disclosed in the above-described embodiment can be altered as appropriate. The drawings schematically illustrate elements of configuration in order to facilitate understanding of the present disclosure. Aspects such as thickness, length, number, and interval of the elements of configuration illustrated in the drawings may differ from actual aspects thereof in order to facilitate preparation of the drawings. Furthermore, configurations of the elements of configuration described in the above embodiment are merely examples and are not intended as specific limitations. Various alterations may be made so long as there is no substantial deviation from the effects of the present disclosure.

For example, the dampening member 6 includes one heater 66 in the embodiment of the present disclosure. However, the dampening member 6 may include two or more heaters 66. For example, the dampening member 6 may include two heaters 66. In the above configuration, it is possible that one of the two heaters 66 is located beside the first flow channel 62*a* while the other of the two heaters 66 is located beside the second flow channel 62*b*.

Furthermore, the dampening member 6 includes one film 65 in the embodiment of the present disclosure. However, the dampening member 6 may include two or more films 65. For example, the dampening member 6 may include two films 65. In the above configuration, it is possible that one of the two films 65 extends along the first flow channel 62*a* while the other of the two films 65 extends along the second flow channel 62*b*.

Only the first flow channel 62*a* of the first and second flow channels 62*a* and 62*b* has the wide portion 621 in the embodiment of the present disclosure. However, the first and second flow channels 62*a* and 62*b* may each have the wide portion 621. Alternatively, only the second flow channel 62*b* may have the wide portion 621.

The head units 1 each include one dampening member 6 in the embodiment of the present disclosure. However, each head unit 1 may include two or more dampening members 6. For example, each head unit 1 may include three dampening members 6. In the above configuration, the dampening members 6 each supply the ink to a corresponding one of the recording heads 2.

The inkjet recording apparatus 100 according to the embodiment of the present disclosure includes four head units 1 but may include one, two, or three head units 1 or five or more head units 1.

The head units 1 in the embodiment of the present disclosure each include three recording heads 2. However, each head unit 1 may include one or two recording heads 2 or four or more recording heads 2.

What is claimed is:

1. A head unit comprising:

a recording head configured to eject an ink;

a pipe member configured to supply the ink to the recording head; and an ink supply section configured to supply the ink to the pipe member, wherein the ink supply section includes:

a flow channel in which the ink flows toward one end of the pipe member;

a heating member that heats the ink flowing in the flow channel; and a base, the base includes wall parts constituting the flow channel, a recess is formed in an outer surface portion of one of the wall parts, and the heating member is disposed in the recess.

2. The head unit according to claim 1, wherein the flow channel includes:

a narrow portion located close to the pipe member; and a wide portion having a width wider than a width of the narrow portion, and the heating member is located beside the wide portion.

3. The head unit according to claim 2, wherein the ink supply section includes a thin film member, and the thin film member constitutes a part of a plane defining inside and outside of the wide portion of the flow channel, the thin film member being deformed by pressure of the ink in the flow channel to absorb pressure variation of the ink in the flow channel.

4. The head unit according to claim 1, wherein the ink supply section includes a thin film member, and the thin film member constitutes a part of a plane defining inside and outside of the flow channel, the thin film member being deformed by pressure of the ink in the flow channel to absorb pressure variation of the ink in the flow channel.

5. The head unit according to claim 1, wherein the heating member is disposed outside one wall part of the wall parts located upper than another wall part of the wall parts.

6. The head unit according to claim 1, wherein the ink supply section further includes a lid covering the recess and the heating member.

7. The head unit according to claim 6, wherein the base has a higher thermal conductivity than the lid.

8. The head unit according to claim 1, comprising:

as the recording head, a plurality of recording heads; and as the pipe member, a plurality of pipe members for each of the recording heads, wherein the flow channel allows the ink to flow to one end of each of at least one of the pipe members.

9. An inkjet recording apparatus comprising the head unit according to claim 1.

10. The head unit according to claim 1, wherein the flow channel includes:

a narrow portion located close to the pipe member; and a wide portion having a sectional area larger than a sectional area of the narrow portion, and the heating member is located along the wide portion.

* * * * *